US008111217B2

(12) United States Patent
Caligiore et al.

(10) Patent No.: US 8,111,217 B2
(45) Date of Patent: Feb. 7, 2012

(54) DRIVING CIRCUIT FOR AN OLED (ORGANIC LIGHT EMISSION DIODE), IN PARTICULAR FOR A DISPLAY OF THE AM-OLED TYPE

(75) Inventors: Claudia Caligiore, Giarre (IT); Giuseppe Antonio Maria Nastasi, Tremestieri Etneo (IT); Lidia Maddiona, Catania (IT); Salvatore Abbisso, Augusta (IT); Salvatore Leonardi, Aci S. Antonio (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 906 days.

(21) Appl. No.: 12/019,577

(22) Filed: Jan. 24, 2008

(65) Prior Publication Data

US 2008/0211746 A1 Sep. 4, 2008

(30) Foreign Application Priority Data

Jan. 24, 2007 (IT) ..... MI2007A0100

(51) Int. Cl.
*G09G 3/30* (2006.01)

(52) U.S. Cl. ..... 345/76; 315/169.3

(58) Field of Classification Search ..... 345/76–83; 315/169.2; 313/463, 504
See application file for complete search history.

(56) References Cited

U.S. PATENT DOCUMENTS 6,958,750 B2 * 10/2005 Azami et al. ..... 345/204
7,102,202 B2 * 9/2006 Kobayashi et al. ..... 257/401
7,173,590 B2 * 2/2007 Uchino et al. ..... 345/92
7,649,515 B2 * 1/2010 Ozawa et al. ..... 345/82
7,692,613 B2 * 4/2010 Choi et al. ..... 345/82

OTHER PUBLICATIONS

Goh et al., "A New Pixel Circuit for Active Matrix Organic Light Emitting Diodes," *IEEE Electron Device Letters 23*(9):544-546, Sep. 2002.

Jung et al., "P-104: A New Voltage Modulated AMOLED Pixel Design Compensating Threshold Voltage Variation of Poly-Si TFTs," *SID 02 Digest 33*(1):622-625, May 2002.

* cited by examiner

*Primary Examiner* — Jimmy H Nguyen

(74) *Attorney, Agent, or Firm* — Lisa K. Jorgenson; E. Russell Tarleton; Seed IP Law Group PLLC

(57) ABSTRACT

A driving circuit of an OLED diode is inserted between a first and a second voltage reference and having at least one input terminal receiving an input voltage signal and an output terminal for the generation of a driving current of the OLED diode, the driving circuit having at least one driver transistor having a first conduction terminal connected to the first voltage reference, a second conduction terminal connected to the output terminal and a control terminal connected to at least one first capacitor and one second capacitor. The first capacitor is inserted between this control terminal and an inner circuit node and the second capacitor is inserted between the inner circuit node and the second voltage reference, the driving circuit 10 further including: a first switch inserted between the input terminal and the inner circuit node; a second switch inserted between the first conduction terminal and control terminal of the driver transistor, and a third switch inserted between the inner circuit node and the second voltage reference, in parallel to the second capacitor, as well as a fourth switch inserted between the first voltage reference and the first conduction terminal of the driver transistor.

18 Claims, 9 Drawing Sheets

DRIVING CIRCUIT FOR AN OLED (ORGANIC LIGHT EMISSION DIODE), IN PARTICULAR FOR A DISPLAY OF THE AM-OLED TYPE

BACKGROUND

1. Technical Field

The present disclosure relates to a driving circuit of an OLED diode (organic light emission diode), and more particularly, but not exclusively, relates to a driving circuit for display applications of the AM-OLED type, and the following description is made with reference to this field of application by way of illustration only.

2. Description of the Related Art

As is known, visualization devices or displays using organic light emission diodes, also indicated as OLED display, acronym from the English: "Organic Light Emitting Diode", have found greater use in recent years.

These OLED displays are generally used in place of the displays with liquid crystals, differently from those that do not require additional components for being illuminated. It is in fact known that the displays with liquid crystals do not produce light, but are illuminated by an external light source, while the OLED devices produce their own light due to the presence of at least one layer of organic material enclosed by suitable metallic layers with the functions of cathode and anode. In particular, due to the monopolar nature of this layer of organic material, the OLED devices conduct current only in one direction, thus behaving similarly to a diode; herefrom the name of O-LED, by way of similitude with LED (acronym from the English: "Light Emitting Diode", i.e., light emission diode).

It is thus possible, by using these OLED diodes, to realize much thinner displays, even flexible and rollable, and requiring smaller amounts of energy to operate.

In its most general form, an OLED display is made of several overlapped layers. In particular, on a first transparent layer, which has protective functions, a transparent conductive layer is deposited serving as an anode; subsequently at least three organic layers are generally added: one for the injection of the holes, one for the transport of electrons, and, between them, the three electroluminescent materials (red, green and blue), arranged to form a single layer made of many elements, each of them being substantially realized by three colored microdisplays. Finally, a reflecting layer is deposited that serves as a cathode.

In spite of the multiple layers, the total thickness, without considering the transparent layer, is of about 300 nanometers, making these OLED displays particularly useful in miniaturized applications.

In general, to form a display, the OLED diodes are organized in a matrix of pixels and are connected to a driving circuit suitable for supplying each OLED diode of this matrix with a current value necessary to obtain the luminescence of the diode itself according to a suitable addressing scheme.

Driving circuits realized in TFT technology (acronym from the English "Thin Film Transistor", i.e., a thin film transistor) are widely used. In this case they are OLED displays with active matrix or AM-OLED, acronym from the English: "Active Matrix—Organic Light Emitting Diode".

In such a driving circuit, a TFT transistor is connected to each OLED diode of the matrix so that, by driving with a suitable voltage the control or gate terminal of this TFT transistor, it is possible to modulate the current supplying the OLED diode, thus obtaining colors of different gradation (generally indicated with the English words grey-level scale or several color scale).

In its most simple form, a driving circuit for an OLED diode is schematically shown in FIG. 1, globally indicated with 1.

This driving circuit 1 has an input terminal IN1 receiving an input voltage signal Vdata and an output terminal OUT1 connected to an OLED diode, indicated as OL, in turn connected to a first voltage reference, in particular a supply voltage reference VDD.

The driving circuit 1 essentially includes a first TFT driver transistor T1, inserted between the output terminal OUT1 and a second voltage reference, in particular a ground GND, and a second TFT selection transistor T2, inserted between a control terminal or gate of the first TFT driver transistor T1 and the input terminal IN1 and having in turn a control or gate terminal receiving a select voltage signal Vsel.

The driving circuit 1 finally includes a storage capacitor Cs inserted between the gate terminal of the first TFT driver transistor T1 and the ground GND.

Essentially, the first TFT driver transistor T1 serves for driving the OLED diode OL, enabled by the second TFT selection transistor T2, which is essentially a switch driven by the select voltage signal Vsel. Moreover, the storage capacitor Cs preserves a piece of electric information (under the form of charge) for the gate terminal of the first TFT driver transistor T1, during the scanning of the other rows of the matrix of pixels, i.e., the so called frame time where the refresh of the whole image occurs.

In the embodiment shown in FIG. 1, the TFT transistors T1 and T2 are N-channel transistors or nTFT.

When the select voltage signal Vsel enables the transmission of the datum, i.e., of the input voltage signal Vdata, through the second TFT selection transistor T2, this input voltage signal Vdata is transferred to the gate terminal of the first TFT driver transistor T1, thus imposing that the current flowing to the OLED diode OL is given by the relation:

$$I_{DS} = \mu_0 C_{ox} \frac{W}{L} \cdot \frac{(V_{GS1} - V_{t1})^2}{2} \tag{1}$$

being $I_{DS}$ the drain current value of the first TFT driver transistor T1 transferred to the OLED diode OL; and $V_{GS1}$, $V_{t1}$, COX, $\mu_0$, W and L are, respectively, the voltage value between the gate and source terminals, the threshold voltage value, the capacity by surface unit, the mobility of the charge carriers, the gate width and length of the first TFT driver transistor T1.

At the end of the so called timing diagram, i.e., of the temporal window wherein the driving signals of the single pixel are applied, the select voltage signal Vsel disables the transfer through the second TFT selection transistor T2, and the datum is maintained between the electrodes of the storage capacitor Cs.

From the equation (1), it is noted how the current $I_{DS}$ that the OLED diode OL is supplied with quadratically depends on the threshold voltage value $V_{t1}$ of the first TFT driver transistor T1.

Unfortunately, it is well known that in the TFT transistors a considerable variation of the threshold voltage can be registered, which is strongly correlated and sensitive to certain process parameters that are to be controlled in an accurate way. With the input voltage signal Vdata identical, a non uniformity follows of the luminosity of the pixels of the matrix of a same AM-OLED display, the driving circuit 1 not succeeding in supplying the OLED diodes of the matrix of pixels with a stable current value.

FIG. 2 shows the simulated progress of the current $I_{DS}$ flowing through the OLED diode OL for three topologically identical circuits, but different as regards the threshold voltage value $V_{t1}$ of the TFT driver transistor T1 comprised therein. The simulations have been carried out with the software AIM-Spice 3.2, using, for the TFT transistors, the level 12.

Moreover, a form ratio (W/L) of the two TFT transistors, T1 and T2, has been considered, fixed at a value equal to $(W/L)_1$=(10 μm)/(5 μm), and $(W/L)_2$=(2 μm)/(2 μm), respectively, with values of the parameters $\mu_0$ and $V_{t1}$, relative to the surface mobility of the carriers and to e threshold voltage, respectively fixed equal to 100 $cm^2$/(Vs) and 2.0 V, with a value of the storage capacitor Cs equal to 1 pF.

From the simulations carried out, it has been verified that, by a variation of ±10% of the threshold voltage value $V_{t1}$ of the first TFT driver transistor T1, a considerable difference is revealed in the values of the current $I_{DS}$ that the OLED diode OL is supplied with. In particular, in correspondence with a variation of +10% ($V_{t1}$=2.2 V, curve F−), a current difference is revealed equal to 10.4% (indicated in the figure as DI−); in correspondence with a variation of −10% ($V_{t1}$=1.8 V, curve F+), it occurs instead that the current has a variation equal to 10.2% (indicated in the figure as DI+).

To overcome the above discussed problem of the luminosity variation between the pixels, different circuit solutions have been proposed using a greater number of devices, in particular TFT transistors.

A first known solution, proposed by S. H. Jung, W. J. Nam, and M. K. Han in the article entitled: "A New Voltage Modulated AMOLED Pixel Design Compensating Threshold Voltage Variation of Poly-Si TFTs", School of Electrical Engineering, Seoul National University, Seoul, KOREA ISSN/0002-0966X/02/3 622•SID 02 DIGEST 301-0622-$1.00+0.00© 2002 SID, is a driving circuit realized with four TFT transistors with p channel or p-TFT and a storage capacitor, schematically shown in FIG. 3 and globally indicated with 3.

This driving circuit 3 has an input terminal IN3 receiving an input voltage signal Vdata and an output terminal OUT3 connected to an OLED diode, always indicated as OL, in turn connected to a first voltage reference, in particular a ground GND.

As previously seen, the driving circuit 3 comprises a first TFT driver transistor T1, inserted between the output terminal OUT3 and a second voltage reference, in particular a supply voltage reference VDD, and a second TFT selection transistor T2 connected to the input terminal IN3 and having in turn a control or gate terminal receiving a select voltage signal Vsel.

The driving circuit 3 also comprises first and second TFT discharge transistors, respectively T3 and T4, diode-wise connected and inserted, in parallel to each other, between the second TFT selection transistor T2 and the gate terminal of the first TFT driver transistor T1.

The driving circuit 3 further includes a storage capacitor Cs inserted between the supply voltage reference VDD and the gate terminal of the first TFT driver transistor T1.

As previously, the TFT transistors T1 and T2 operate, respectively, as driver and as switch, while the block formed by the transistors T3 and T4 allows to discharge the storage capacitor Cs for the refresh of the information and enhance the voltage value at the gate terminal of the first TFT driver transistor T1 by an amount equal to the threshold voltage $V_{t3}$ of the second TFT discharge transistor T3.

In fact, when the select voltage signal Vsel turns on the second TFT selection transistor T2, the datum is transferred to the gate terminal of the first TFT driver transistor T1 through the second TFT discharge transistor T3 which is diode-wise connected. The current transferred to the OLED diode OL is given, therefore, by the relation:

$$|I_{DS}| = \mu_0 C_{ox} \frac{W}{L} \cdot \frac{(|V_{GS1}| - |V_{t1}|)^2}{2} = \mu_0 C_{ox} \frac{W}{L} \cdot \frac{(V_{DD} - V_{data} + |V_{t3}| - |V_{t1}|)^2}{2} \quad (2)$$

wherein:

$I_{DS}$ is the drain current value of the first TFT driver transistor T1 transferred to the OLED diode OL;

Vdata is the input voltage signal or datum; and $V_{GS1}$, $V_{t1}$, COX, $\mu_0$, W and L are, respectively, the voltage value between the gate and source terminals, the threshold voltage values, the capacity by surface unit, the mobility of the charge carriers, the gate width and length of the first TFT driver transistor T1; and $V_{t3}$ is the threshold voltage value of the second TFT discharge transistor T3.

If the electric characteristics of the first TFT driver transistor T1 and of the second TFT discharge transistor T3 are rather similar, $|V_{t1}| \approx |V_{t3}|$ can be supposed; the drain current $I_{DS}$ will thus have the form:

$$|I_{DS}| = \mu_0 C_{ox} \frac{W}{L} \cdot \frac{(V_{DD} - V_{data})^2}{2} \quad (3)$$

From the equation (3) it thus emerges that the driving circuit 3 allows to obtain a drain current value $I_{DS}$ independent from the threshold voltage $V_{t1}$ of the first TFT driver transistor T1.

However, the correct operation of the circuit is based on the assumption that the transistors T1 and T3 have the same threshold voltage, condition, which can be hardly obtained in the practice.

J. C. Goh, H. J. Chung, J. Jang and C. H. Han in the article entitled: "A New Pixel Circuit for Active Matrix Organic Light Emitting Diodes", IEEE ELECTRON DEVICE LETTERS, VOL. 23, NO. 9, September 2002 thus have proposed a further driving circuit able to solve this problem. This driving circuit is schematically shown in FIG. 4, globally indicated with 4, using four TFT N-channel transistors, or n-TFT and two capacitors.

The driving circuit 4 has an input terminal IN4 receiving an input voltage signal Vdata and an output terminal OUT4 connected to a OLED diode, always indicated as OL, in turn connected to a first voltage reference, in particular a ground GND.

As previously seen, the driving circuit 4 comprises a first TFT driver transistor T1, inserted between the output terminal OUT4 and a second voltage reference, in particular a supply voltage reference VDD, and a second TFT selection transistor T2, inserted between a control or gate terminal of the first TFT driver transistor T1 and the input terminal IN4 and having in turn a control or gate terminal receiving a first select voltage signal Vsel1.

The driving circuit 4 also includes a third TFT selection transistor and a fourth TFT selection transistor, respectively T3 and T4, inserted, in series with each other, between the output terminal OUT4 and the input terminal IN4 and having respective control or gate terminals, the first receiving a signal Vsel1 and the second receiving a select voltage signal Vsel2.

The driving circuit 4 further includes a storage capacitor Cs inserted between an inner circuit node X4 of interconnection between the third and fourth TFT selection transistors, T3 and T4, and the supply voltage reference VDD, as well as a bootstrap capacitor Cb, inserted between the gate terminal of the first TFT driver transistor T1 and the inner circuit node X4.

The driving circuit 4 provides a Timing diagram divided into three periods:

(1) a first initialization period;

(2) a second compensation period, and (3) a third data-input period.

The waveforms relative to this Timing diagram are shown in FIG. 5.

In the initialization period, the first and the second select voltage signals, Vsel 1 and Vsel2, are led to a first voltage value or high value, enabling all the three TFT selection transistors T2, T3 and T4 and thus realizing the discharge of the bootstrap capacitor Cb.

In the compensation period, while the first select voltage signal Vsel1 is maintained at the high level, the second select voltage signal Vsel2 is led to a second value or low value causing the opening of the fourth TFT selection transistor T4. Moreover, thanks to the modulation of the input voltage signal Vdata which is led to an intermediate value, next to the value of the threshold voltage of the first TFT driver transistor T1, the operation of the first TFT driver transistor T1 is forced to the underthreshold region. In this way, the voltage value between the gate and source terminals of this first TFT driver transistor T1, equal to $V_{t1}$, is applied to the electrodes of the bootstrap capacitor Cb and preserved for the last fraction of the frame time, i.e., the data-input period.

In particular, in this data-input period, the first select voltage signal Vsel1 is led to the low value, while the second select voltage signal Vsel2 is led to the high value, causing the opening of the second and third TFT selection transistors, T2 and T3 and the closing of the fourth TFT selection transistor T4. Moreover, the electric information is applied to the input voltage signal Vdata on the basis of the changes introduced.

In this way, the voltage at the gate terminal of the first TFT driver transistor T1 is equal to Vdata+$V_{t1}$, and the drain current $I_{DS}$ is given by the relation:

$$\begin{aligned} I_{DS} &= \mu_0 C_{ox} \frac{W}{L} \cdot \frac{(V_{GS1} - V_{t1})^2}{2} \\ &= \mu_0 C_{ox} \frac{W}{L} \cdot \frac{(V_{data} + V_{t1} - V_{t1})^2}{2} \\ &= \mu_0 C_{ox} \frac{W}{L} \cdot \frac{V_{data}^2}{2} \end{aligned} \tag{4}$$

From the equation (4), it occurs that the driving circuit 4 obtains a drain current value $I_{DS}$ independent from the threshold voltage $V_{t1}$ of the first TFT driver transistor T1.

This solution, however, shows an important limit, due to the fact that its correct operation is tied to the application, during the second compensation period, of such a voltage intermediate value as to put the first TFT driver transistor T1 in the underthreshold region. Given the impossibility to realize all the TFT transistors present in the driving circuit of a matrix of pixels with the same electric characteristics, it is thus difficult that the voltage intermediate value applied in this period can ensure, for all the driver transistors, a correct operation under the underthreshold condition.

The technical problem underlying the present disclosure is that of devising a driving circuit for a display of the AM-OLED type, having such structural and functional characteristics as to obtain a driving current value independent from the threshold voltage variations of the TFT transistors contained therein, overcoming the limits and the drawbacks still affecting the circuits realized according to the prior solutions.

BRIEF SUMMARY

The present disclosure provides a self-regulation of the circuit leading to the automatic identification of the threshold voltage of the driver transistors contained therein, such voltage being stored across a bootstrap capacitor.

On the basis of this disclosure, the technical problem is solved by the driving circuit of an OLED diode inserted between a first voltage reference and a second voltage reference and having at least one input terminal receiving an input voltage signal and an output terminal for the generation of a driving current of this OLED diode, the circuit including at least one driver transistor having a first conduction terminal connected to this first voltage reference, a second conduction terminal connected to this output terminal and a control terminal connected to at least one first capacitor and one second capacitor.

Advantageously according to the disclosure, the first capacitor is inserted between the control terminal and an inner circuit node and the second capacitor is inserted between this inner circuit node (X2) and the second voltage reference.

Further advantageously, the driving circuit also includes:

- a first switch driven by a first select voltage signal and inserted between the input terminal and the inner circuit node;
- a second and a third switch driven by a second select voltage signal, this second switch inserted between the first conduction terminal and the control terminal of the driver transistor, and the third switch inserted between the inner circuit node and the second voltage reference, in parallel with the second capacitor; and
- a fourth switch driven by a third select voltage signal and inserted between the first voltage reference and the first conduction terminal of the driver transistor.

Advantageously, the first select voltage signal enables the opening of the first switch, the second select voltage signal enables the conduction of the second and third switches and the third select voltage signal enables the conduction of the fourth switch, triggering a charge step of the first capacitor with the function of a bootstrap at a voltage value higher than a threshold voltage value of the driver transistor.

Further advantageously, a switch of the third select voltage signal enables the opening of the fourth switch, triggering a discharge step of the first bootstrap capacitor, a voltage value across it being led to a value equal to the threshold voltage of the driver transistor.

Moreover, a switch of the first, second and third select voltage signal enables the opening of the second and third switch and the closing of the first and fourth switch, respectively, thus applying to the control terminal of the driver transistor a voltage equal to the sum of the input voltage signal and of the voltage value stored in the first bootstrap capacitor, equal to the threshold voltage value of the driver transistor and generating the driving current according to the following relation:

$$I_{DS} = \mu_0 C_{ox} \frac{W}{L} \cdot \frac{(V_{GS1} - V_{tf1})^2}{2} = \mu_0 C_{ox} \frac{W}{L} \cdot \frac{(V_{data} + V_{tf1} - V_{tf1})^2}{2} = \mu_0 C_{ox} \frac{W}{L} \cdot \frac{V_{data}^2}{2}$$

wherein:

$V_{GS1}$, $V_{tf1}$, COX, $\mu_0$, W and L are, respectively, the voltage value between the gate and source terminals, the threshold voltage value, the capacity by surface unit, the mobility of the charge carriers, the gate width and length of said driver transistor.

Finally, the switch of the first, second and third select enable signal enables the storage in the second capacitor of the charge supplied to the control terminal of the driver transistor until a new input voltage signal comes.

Further advantageously, the driver transistor and the switches are realized by respective thin film N-channel transistors.

The problem is also solved by a method for generating a driving current of an OLED diode by means of a driving circuit thus made, the method including, in sequence, the steps of:

initialization, wherein the first select voltage signal is at a first level enabling the opening of the first switch, the second select voltage signal is led to a second level, enabling the closing of the second switch and of the third switch and the third select voltage signal is at this second level, enabling the closing of the fourth switch, triggering a charge step of the first capacitor with the function of a bootstrap at a voltage value higher than a threshold voltage value of the driver transistor;

compensation, wherein the first and the second select voltage signals, are maintained at the same level as in the previous initialization step, respectively the first level and second level, while the third select voltage signal is led to the first level, enabling the opening of the fourth switch, the first switch keeping open, thus triggering a discharge step of the first bootstrap capacitor, a voltage value across this capacitor being led to a value equal to the threshold voltage of the driver transistor; and data-input, wherein the first and the third select voltage signals are led to the second level and the second select voltage signal is led to the first level, enabling the opening of the second and third switches and the closing of the first and fourth switches, respectively, thus applying to the control terminal of the driver transistor a voltage equal to the sum of the input voltage signal and of the voltage value stored in the first bootstrap capacitor, equal to the threshold voltage value of the driver transistor and generating the driving current according to the following relation:

$$I_{DS} = \mu_0 C_{ox} \frac{W}{L} \cdot \frac{(V_{GS1} - V_{tf1})^2}{2} = \mu_0 C_{ox} \frac{W}{L} \cdot \frac{(V_{data} + V_{tf1} - V_{tf1})^2}{2} = \mu_0 C_{ox} \frac{W}{L} \cdot \frac{V_{data}^2}{2} \quad (5)$$

wherein:

$V_{GS1}$, $V_{tf1}$, COX, $\mu_0$, W and L are, respectively, the voltage value between the gate and source terminals, the threshold voltage value, the capacity by surface unit, the mobility of the charge carriers, the gate width and length of the driver transistor.

In accordance with another embodiment of the present disclosure, a circuit is provided that includes a driver transistor having a first terminal coupled to a first voltage reference, a second terminal coupled to an output that is coupled to a second voltage reference, and a control terminal; a first capacitor coupled to a first node and to the control terminal of the driver transistor; a second capacitor coupled to the first node and to the second voltage reference; a first switch coupled between an input terminal and the first node; a second switch coupled between the first terminal of the driver transistor and the control terminal of the driver transistor; a third switch coupled between the second capacitor and the second voltage reference; and a fourth switch coupled between the first voltage reference and the first terminal of the driver transistor.

In accordance with another aspect of the foregoing embodiment, the driving circuit generates a driving current on an output at the second terminal of the driver transistor in accordance with the following relationship:

$$I_{DS} = \mu_0 C_{ox} \frac{W}{L} \cdot \frac{(V_{GS1} - V_{tf1})^2}{2} = \mu_0 C_{ox} \frac{W}{L} \cdot \frac{(V_{data} + V_{tf1} - V_{tf1})^2}{2} = \mu_0 C_{ox} \frac{W}{L} \cdot \frac{V_{data}^2}{2}$$

wherein: $V_{GS1}$, $V_{tf1}$, COX, $\mu_0$, W and L are, respectively, the voltage value between the gate and source terminals, the threshold voltage value, the capacity by surface unit, the mobility of the charge carriers, the gate width and length of said driver transistor.

In accordance with another aspect of the foregoing embodiment, the first capacitor is adapted to be charged to a higher voltage than the threshold voltage value of the driver transistor. Ideally, when the first capacitor is adapted to be charged, the first switch is open, and the second, third, and fourth switches are closed.

Accordance with another embodiment of the present disclosure, a display device is provided that includes a plurality of organic light emission diodes (OLEDs); and a circuit for driving each OLED, the circuit including: a driver transistor having a first terminal coupled to a first voltage reference, a second terminal coupled to an output that is coupled to a second voltage reference, and a control terminal; a first capacitor coupled to a first node and to the control terminal of the driver transistor; a second capacitor coupled to the first node and to the second voltage reference; a first switch coupled between an input terminal and the first node; a second switch coupled between the first terminal of the driver transistor and the control terminal of the driver transistor; a third switch coupled between the second capacitor and the second voltage reference; and a fourth switch coupled between the first voltage reference and the first terminal of the driver transistor.

In accordance with another aspect of the foregoing embodiment, the driving circuit generates a driving current on an output at the second terminal in accordance with the following relationship:

$$I_{DS} = \mu_0 C_{ox} \frac{W}{L} \cdot \frac{(V_{GS1} - V_{tfl})^2}{2} = \mu_0 C_{ox} \frac{W}{L} \cdot \frac{(V_{data} + V_{tfl} - V_{tf1})^2}{2} = \mu_0 C_{ox} \frac{W}{L} \cdot \frac{V_{data}^2}{2}$$

wherein: $V_{GS1}$, $V_{tf1}$, COX, $\mu_0$, W and L are, respectively, the voltage value between the gate and source terminals, the threshold voltage value, the capacity by surface unit, the mobility of the charge carriers, the gate width and length of said driver transistor.

BRIEF DESCRIPTION OF THE SEVERAL VIEWS OF THE DRAWINGS

The characteristics and the advantages of the driving circuit according to the disclosure will be apparent from the following description of an embodiment thereof given by way of indicative and non limiting example with reference to the annexed drawings.

In these drawings.

DETAILED DESCRIPTION

Figure 6A:
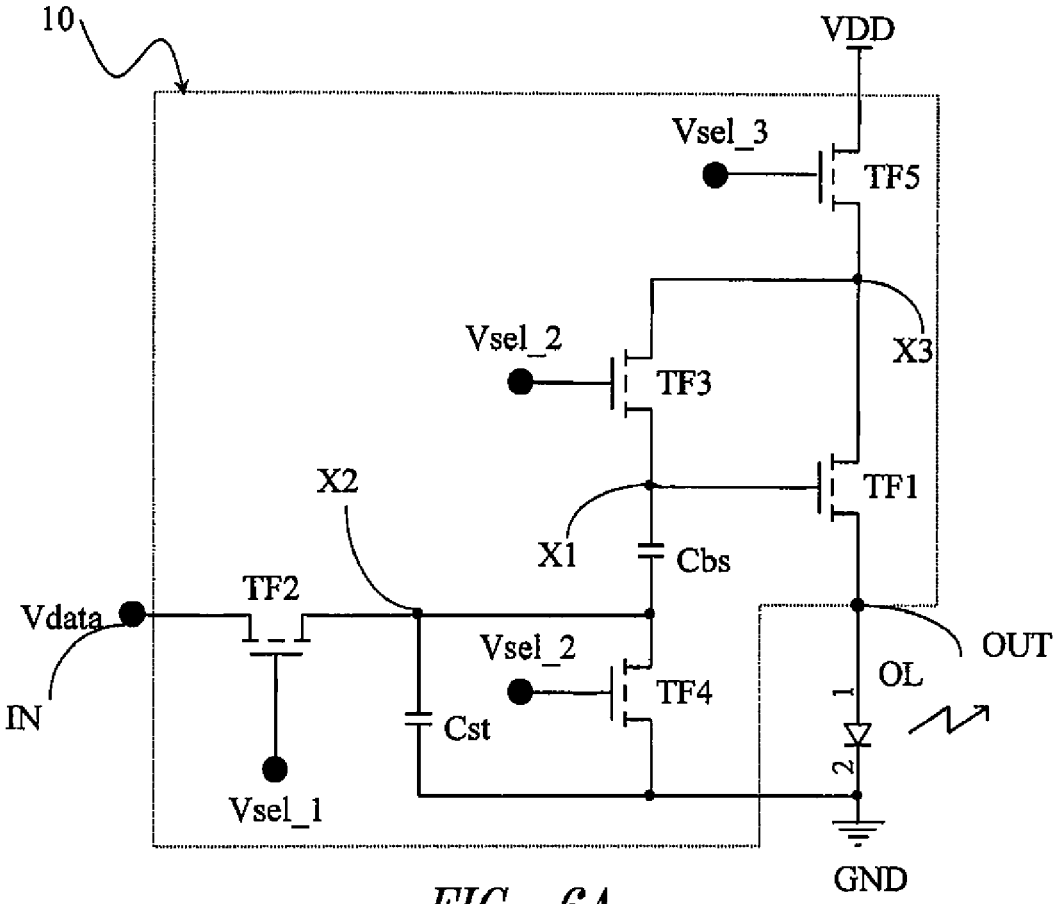
FIG. 6A schematically shows a driving circuit realized according to the present disclosure.
Figure 6B:
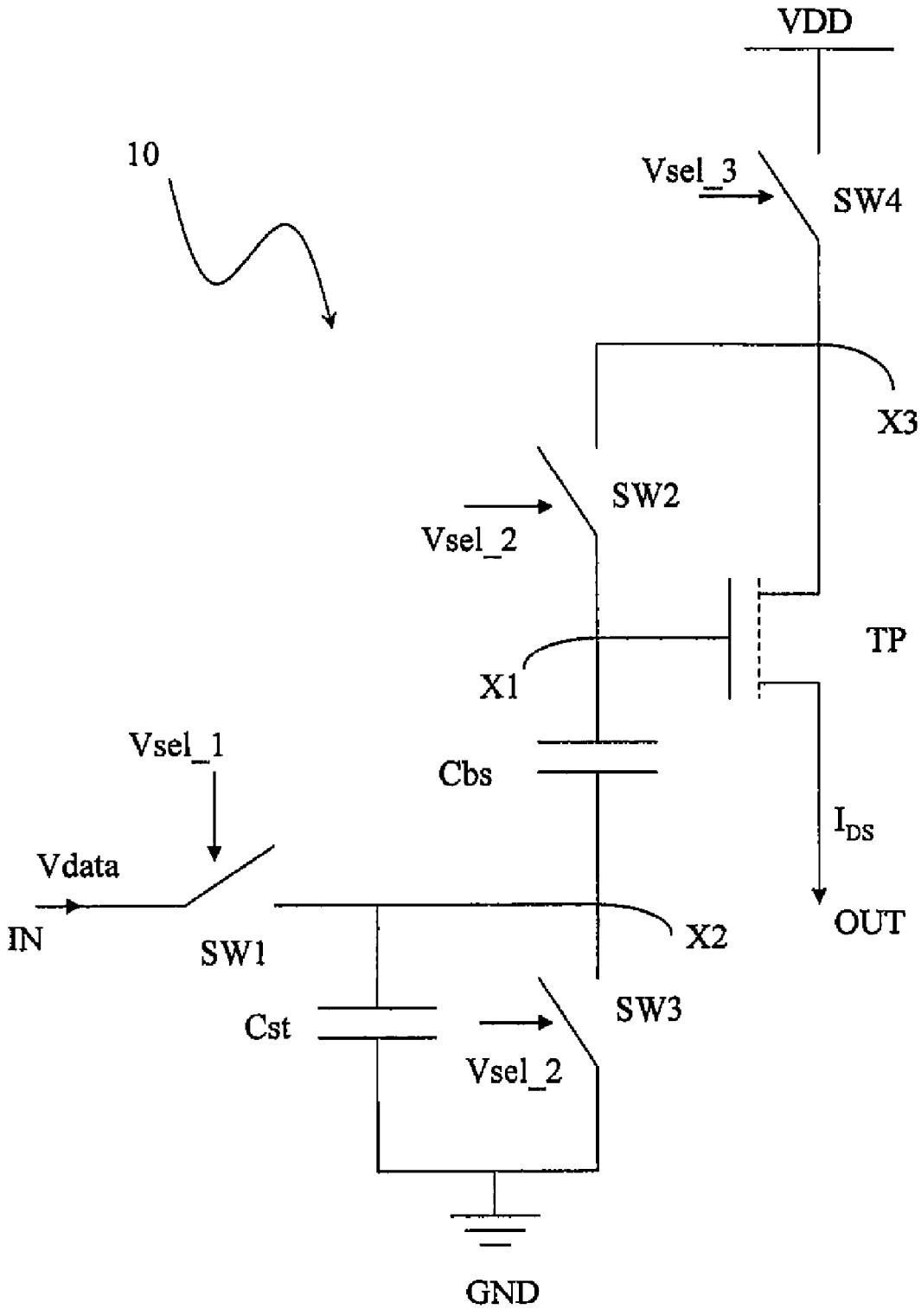
FIG. 6B shows a simplified schematization of the driving circuit of FIG. 6A.

With reference to these figures, and in particular to FIGS. 6A and 6B, reference numeral 10 globally and schematically indicates a driving circuit for an AM-OLED display realized according to the present disclosure.

The driving circuit 10 includes five active devices, in particular TFT N-channel transistors or n-TFT, and two passive devices, in particular two capacitors.

More in detail, the driving circuit 10 has an input terminal IN receiving an input voltage signal Vdata or datum and an output terminal OUT connected to an OLED diode, indicated with OL, in turn connected to a first voltage reference, in particular a ground GND. The output terminal OUT supplies the OLED diode OL with a driving current IDS.

The driving circuit 10 includes a TFT driver transistor TF1 connected between a second voltage reference, in particular a supply voltage reference VDD via internal circuit node X3, and the output terminal OUT and a first TFT selection transistor TF2, in turn connected to the input terminal IN and having a control or gate terminal receiving a first select voltage signal Vsel_1. In particular, the first TFT selection transistor TF2 realizes a switch controlled by the first select voltage signal Vsel_1.

Advantageously, the driving circuit 10 also includes at least one second and one third TFT selection transistor, respectively TF3 and TF4, inserted, in series with each other, between the supply voltage reference VDD via internal circuit node X3 and the ground GND and having a respective control or gate terminal receiving a second select voltage signal Vsel_2. Similarly, the second and third TFT selection transistors, TF3 and TF4, realize respective switches controlled by the second select voltage signal Vsel_2.

The driving circuit 10 further includes a storage capacitor Cst inserted between the first TFT selection transistor TF2 and the ground GND, as well as a bootstrap capacitor Cbs inserted between the second TF3 and the third TFT selection transistors TF4.

More in detail, the second TFT transistor TF3 is inserted between the supply voltage reference VDD and a control or gate terminal of the TFT driver transistor TF1, indicated as first inner circuit diode X1, the bootstrap capacitor Cbs is inserted between the first inner circuit node X1 and the conduction terminal of the first TFT selection transistor TF2, indicated as second inner circuit node X2, the third TFT selection transistor TF4 is inserted between the second inner circuit node X2 and the ground GND, and the storage capacitor Cst is inserted, in parallel with the third TFT selection transistor TF4, between the second inner circuit node X2 and the ground GND.

Further advantageously, the driving circuit 10 includes a fourth TFT selection transistor TF5, inserted between the supply voltage reference VDD and the TFT driver transistor TF1 and having a control or gate terminal receiving a third select voltage signal Vsel_3. In this case, the fourth TFT selection transistor TF5 realizes a switch controlled by the third select voltage signal Vsel_3. More in particular, the fourth TFT selection transistor TF5 is inserted between the supply voltage reference VDD and a conduction terminal of the TFT driver transistor TF1, indicated as a third inner circuit node X3, in turn connected to the second TFT selection transistor TF3.

In substance, in its most simple form, the driving circuit 10 according to the disclosure includes at least one driver transistor suitably connected to the supply voltage references and ground as well as to two capacitors through four driven switches. A schematization of the driving circuit 10 is reported in FIG. 6B.

The driving circuit 10 includes at least one driver transistor TP connected to the output terminal OUT for the generation of the driving current IDS of the OLED diode OL. As previously seen, the driver transistor TP is realized by the transistor TFT TF1.

Advantageously, the driving circuit 10 also includes a bootstrap capacitor Cbs inserted between a control terminal X1 of the driver transistor TP and a second inner circuit node X2 and a storage capacitor Cst inserted between the second inner circuit node X2 and the ground GND.

The second inner circuit node X2 is also connected to the input terminal IN of the driving circuit 10 through a first switch SW1 driven by the first select voltage signal Vsel_1. The first switch SW1 is realized by the first TFT selection transistor TF2.

Further advantageously, the driving circuit 10 also has second and third switches, SW2 and SW3, driven by the second select voltage signal Vsel_2. In particular, the second switch SW2 is inserted between a conduction terminal, corresponding to a third inner circuit node X3, and the control terminal X1 of the driver transistor TP, while the third switch SW3 is inserted between the second inner circuit node X2 and the ground GND, in parallel to the storage capacitor Cst. The second and third switches, SW2 and SW3, are realized by the second and third TFT selection transistors, TF3 and TF4, respectively.

Finally, the driving circuit 10 includes a fourth switch SW4 driven by the third select voltage signal Vsel_3 and inserted between the supply voltage reference VDD and the third inner circuit node X3. The fourth switch SW4 is realized by the fourth TFT selection transistor TF5.

Described in more detail below is the operation of the driving circuit 10 according to the disclosure.

Advantageously, the select voltage signals, Vsel_1, Vsel_2. and Vsel_3 divide the Timing diagram into three periods:

(1) a first initialization period P1;

(2) a second compensation period P2; and (3) a third data-input period P3.

Figure 7:
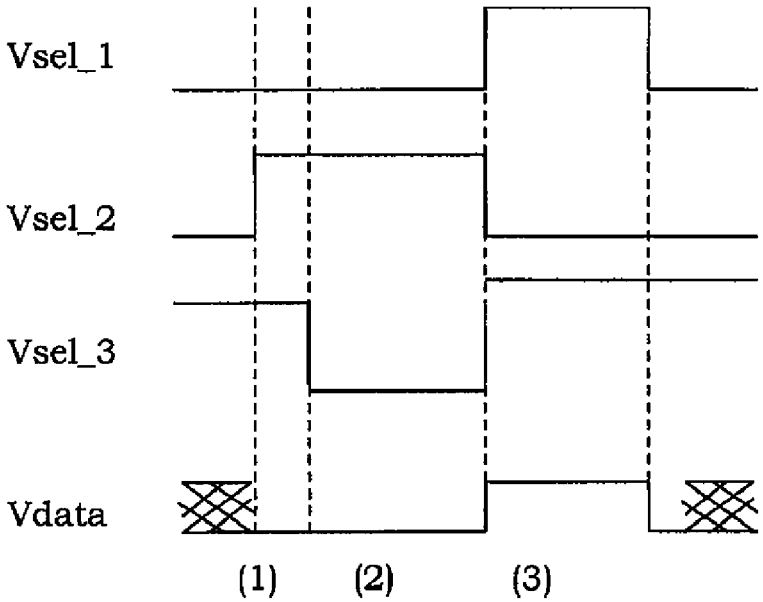
FIG. 7 schematically shows the progress of control signals of the driving circuit of FIG. 6A.

The waveforms taken by the select voltage signals, Vsel_1, Vsel_2, and Vsel_3 relative to a Timing diagram are shown in FIG. 7.

An initial condition is considered in which the first and the second select voltage signals, Vsel_1 and Vsel_2, are at a first level, in particular low, while the third select voltage signal, Vsel_3, is at a second level, in particular high.

In the first initialization period P1, the second select voltage signal, Vsel_2, is led to a high level, enabling the second and the third TFT selection transistors, TF3 and TF4. Similarly, the third select voltage signal, Vsel_3, is led to a high level enabling the fourth TFT selection transistor TF5.

In this way a charge step of the bootstrap capacitor Cbs is triggered at a voltage value higher than the threshold voltage value Vtf1 of the TFT driver transistor TF1.

In the second compensation period P2, the first and second select voltage signals, Vsel_1 and Vsel_2, are maintained at the same level, respectively low and high, while the third select voltage signal Vsel_3 is led to a low value, opening the fourth TFT selection transistor TF5, with the first TFT selection transistor TF2 keeping open.

In this way a discharge step of the bootstrap capacitor Cbs is triggered and the voltage across it is led to a value equal exactly to the threshold voltage Vtf1 of the TFT driver transistor TF1.

In the third data-input period P3, all the select voltage signals change level. In particular, the first select voltage signal Vsel_1 and the third select voltage signal Vsel_3 are led to the high level and the second select voltage signal Vsel_2 is led to the low level, opening the second and the third TFT selection transistors, TF3 and TF4, and closing the first and the fourth TFT selection transistors, TF2 and TF5. It is thus possible to apply to the input voltage signal Vdata the electric information, i.e., a voltage corresponding to the luminosity value that is to be taken by the corresponding pixel, as indicated by its enhancement to the high level.

In this third data-input period P3, the voltage value applied to the gate terminal of the TFT driver transistor TF1 is thus equal to Vdata+Vtf1, and its drain current $I_{DS}$ is given by the following relation:

$$\begin{aligned} I_{DS} &= \mu_0 C_{ox} \frac{W}{L} \cdot \frac{(V_{GS1} - V_{tf1})^2}{2} \\ &= \mu_0 C_{ox} \frac{W}{L} \cdot \frac{(V_{data} + V_{tf1} - V_{tf1})^2}{2} \\ &= \mu_0 C_{ox} \frac{W}{L} \cdot \frac{V_{data}^2}{2} \end{aligned} \tag{5}$$

corresponding to the equation (4) seen with reference to the prior solution, also in this case being:

$I_{DS}$ is the value of the drain current of the first TFT driver transistor T1 transferred to the OLED diode OL;

Vdata is the input voltage signal or datum; and $V_{GS1}$, $V_{tf1}$, COX, $\mu_0$, W and L are, respectively, the voltage value between the gate and source terminals, the threshold voltage value, the capacity by surface unit, the mobility of the charge carriers, the gate width and length of the TFT driver transistor TF1.

The storage capacitor Cst stores the charge supplied to the gate terminal of the TFT driver transistor TF1, i.e., to the first inner circuit node X1, until a new input voltage signal Vdata comes.

In substance, advantageously according to this disclosure, the first select voltage signal Vsel_1 enables the opening of the first switch SW1, the second select voltage signal Vsel_2 enables the conduction of the second and of the third switches, SW2 and SW3, and the third select voltage signal Vsel_3 enables the fourth switch SW4, triggering a charge step of the bootstrap capacitor Cbs at a voltage value higher than the threshold voltage value Vtf1 of the driver transistor TP.

Moreover, the switch of the third select voltage signal Vsel_3 enables the opening of the fifth switch SW4, triggering a discharge step of the bootstrap capacitor Cbs, thereby the voltage across it is led to a value equal to the threshold voltage Vtf1.

Finally, a switch of the first, second and third select voltage signals, Vsel_1, Vsel_2, and Vsel_3, enables the opening of the second and of the third switches, SW2 and SW3, and the closing of the first and of the fourth switches, SW1 and SW4, respectively, thus applying to the control terminal X1 of the driver transistor TP a voltage equal to the sum of the input voltage signal Vdata and of the voltage value stored in the bootstrap capacitor Cbs, equal to the threshold voltage value Vtf1 of the driver transistor TP and generating the driving current IDS according to the above indicated relation (5).

To better understand the operation of the driving circuit 10, it is possible to refer to its circuit equivalents in the different operative steps, i.e., in the different periods in the Timing diagram, as hereafter described.

First Initialization Period P1

Figure 8:
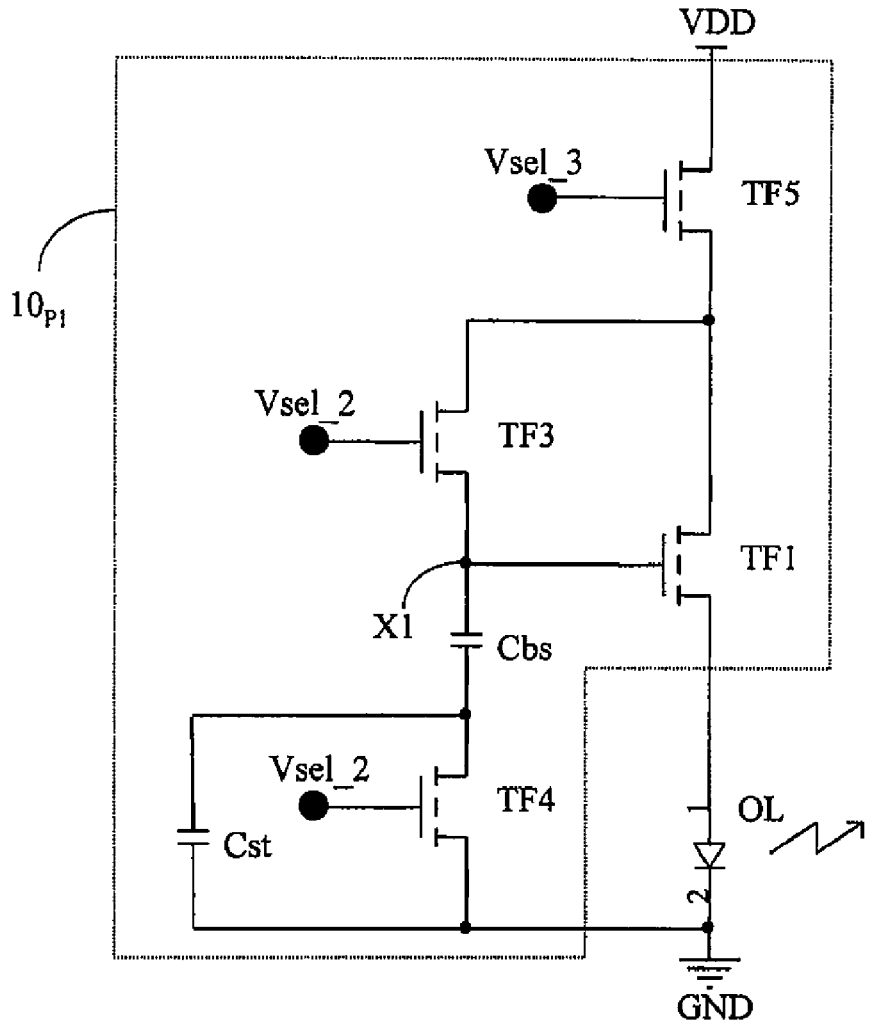
FIG. 8 schematically shows a circuit equivalent of the driving circuit of FIG. 6A under a first operation condition.

The driving circuit 10, taking into account the sole transistors at stake, is reduced to its equivalent $\mathbf{10}_{P1}$ of FIG. 8.

In this first initialization period P1, the charge of the bootstrap capacitor Cbs is determined at a value higher than the threshold voltage Vtf1 of the TFT driver transistor TF1.

Figure 9:
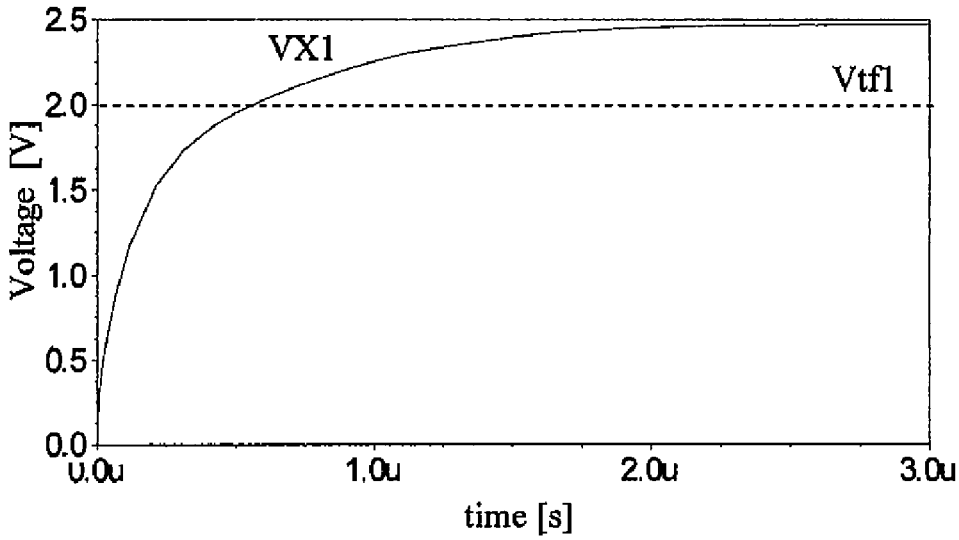
FIG. 9 schematically shows the progress of a voltage signal obtained by the driving circuit of FIG. 6A under the first operation condition.

The progress of the voltage VX1 in the first inner circuit node X1 is reported in FIG. 9, where the value of the threshold voltage Vtf1 of the TFT driver transistor TF1 has been indicated with a dotted line.

It is then observed, as already previously introduced, that the value of the voltage VX1 of the first inner circuit node X1 at the end of the first initialization period P1 exceeds the value of the threshold value Vtf1 of the TFT driver transistor TF1.

Second compensation period P2

Figure 10:
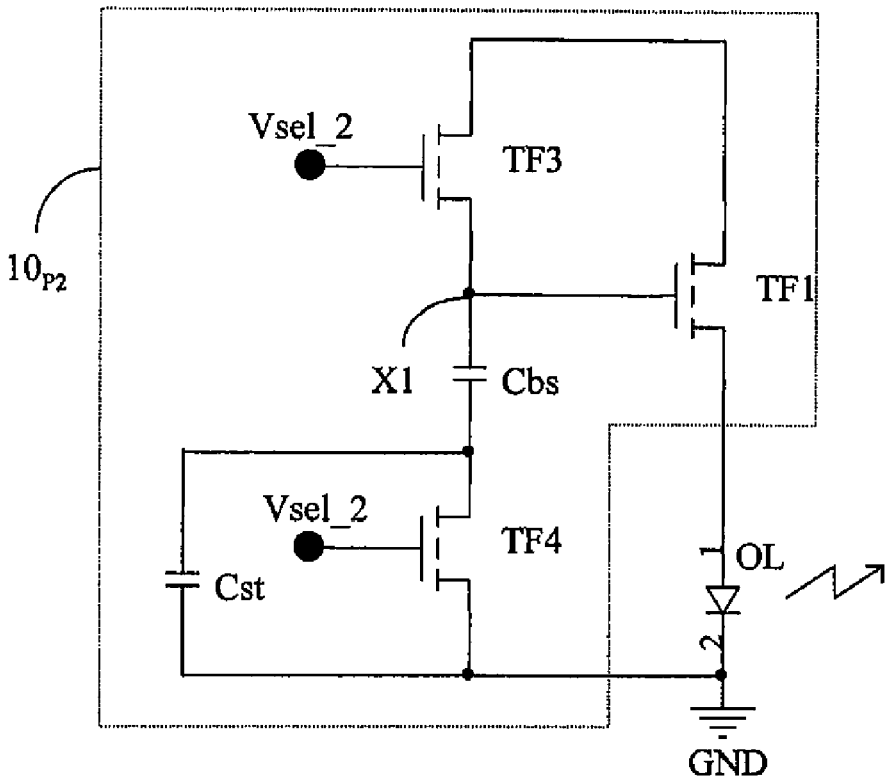
FIG. 10 schematically shows a circuit equivalent of the driving circuit of FIG. 6A under a second operation condition.

With the opening of the fourth TFT selection transistor TF5 and with the first TFT selection transistor TF2 kept open, the driving circuit 10 is reduced to its equivalent $10_{P2}$ of FIG. 10.

Across the bootstrap capacitor Cbs a voltage value equal to the threshold voltage Vtf1 of the TFT driver transistor TF1 is automatically stored, without the need of any external intervention. The driving circuit 10 according to the disclosure is thus self-regulated and enables storing in the bootstrap capacitor Cbs the exact value of the threshold voltage Vtf1 of the TFT driver transistor TF1, a value necessary for the compensation of the drain current IDS supplied on the output terminal OUT of the driving circuit 10 itself.

In fact, advantageously according to the disclosure, the bootstrap capacitor Cbs, when the voltage across it is higher than the threshold voltage value Vtf1 of the TFT driver transistor TF1, determines the conduction of this transistor, which in turn triggers the discharge step of the bootstrap capacitor Cbs. This discharge step goes on until the voltage value across the bootstrap capacitor Cbs reaches exactly the desired value of the threshold voltage Vtf1 of the TFT driver transistor TF1.

Figure 11:
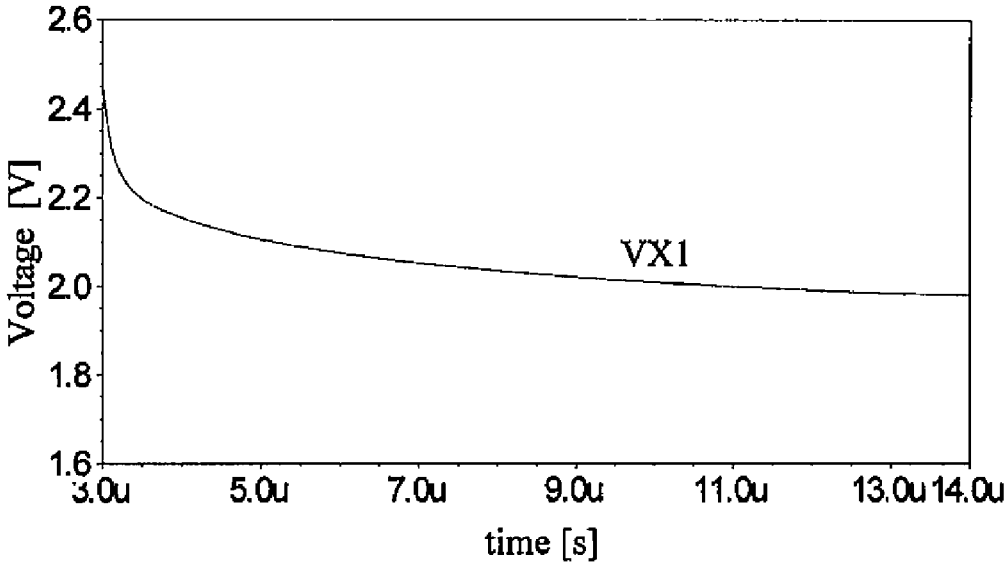
FIG. 11 schematically shows the progress of a voltage signal obtained by the driving circuit of FIG. 6A under the second operation condition.

At this point, the TFT driver transistor TF1 is disabled and the bootstrap capacitor Cbs maintains the voltage value attained, i.e., the value of the threshold voltage Vtf1 of the TFT driver transistor TF1, as schematically shown in FIG. 11 where the progress of the voltage in the first inner circuit node X1, connected to the bootstrap capacitor Cbs, is shown.

In this way, to overcome the drawbacks highlighted in connection with the known driving circuits, independently from the value of the threshold voltage Vtf1 of the TFT driver transistor TF1, a self-regulation occurs of the driving circuit 10 that leads to the storage, always, of this value of threshold voltage Vtf1 across the bootstrap capacitor Cbs.

Third Data-Input Period P3

Figure 12:
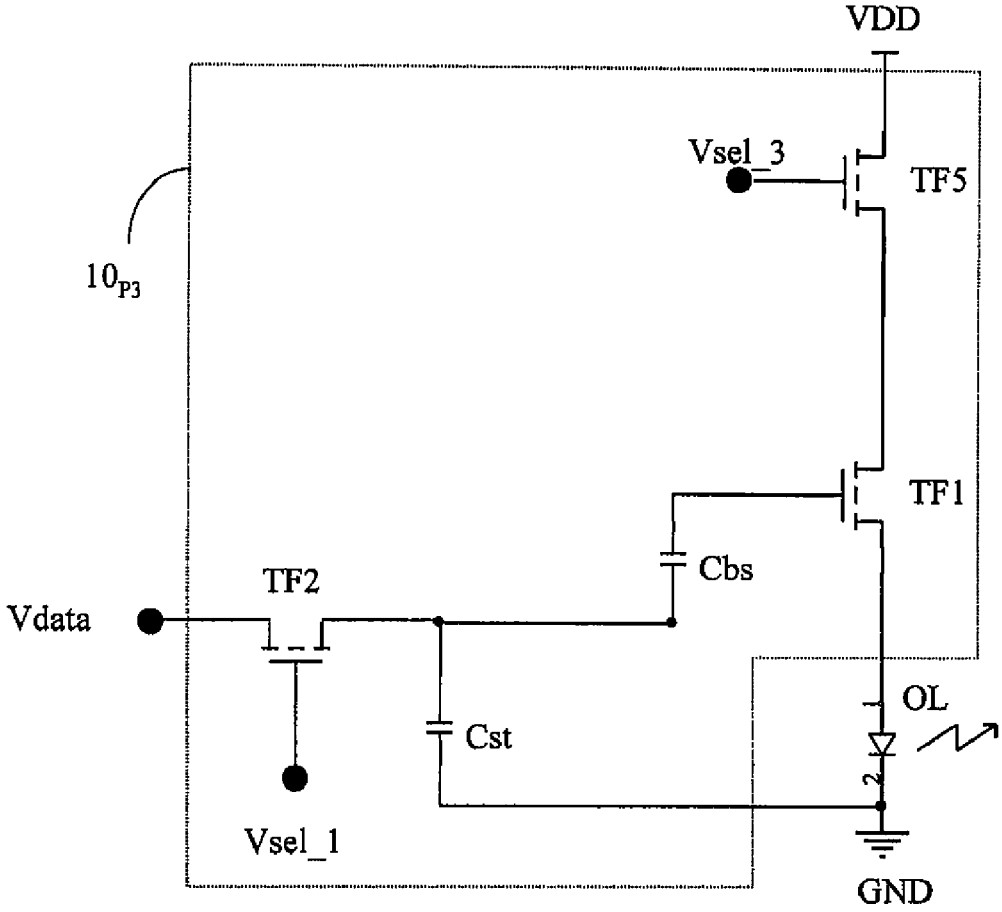
FIG. 12 schematically shows a circuit equivalent of the driving circuit of FIG. 6A under a third operation condition.

With the opening of the second and of the third TFT selection transistors, TF3 and TF4, and the closing of the first and fourth selection transistors, TF2 and TF5, the driving circuit 10 is reduced to its equivalent $10_{P3}$ of FIG. 12.

In this period the driving in voltage of the OLED diode OL occurs with a current IDS having the expression defined in the above reported equation (5).

In particular, since in the bootstrap capacitor Cbs a voltage value equal to the threshold voltage value Vtf1 of the TFT driver transistor TF1 is stored, when one acts with the input voltage signal Vdata, the voltage value in the first inner circuit node X1 is equal to Vdata+Vtf1.

The present disclosure thus relates to a method for generating a driving current IDS of an OLED diode OL in a matrix of pixels of an AM-OLED display by means of a driving circuit of the illustrated type, the method including, in sequence, the steps of:

initialization, in which the first select voltage signal Vsel_1 is at a first level, in particular a low level, determining the opening of the first switch SW1, the second select voltage signal Vsel_2 is led to a second level, in particular a high level, enabling the second and the third switches, SW2 and SW3, and the third select voltage signal Vsel_3 is at the high level, enabling the fourth switch SW4 triggering a charge step of the bootstrap capacitor Cbs at a voltage value higher than the threshold voltage value Vtf1 of the driver transistor TP;

compensation, in which the first and second select voltage signals, Vsel_1 and Vsel_2, are maintained at the same level, respectively low and high, while the third select voltage signal Vsel_3 is led to the low level, opening the fourth switch SW4, the first switch SW1 keeping open, thus triggering a discharge step of the bootstrap capacitor Cbs and the voltage across it is led to a value exactly equal to the threshold voltage Vtf1 of the driver transistor TP; and data-input, in which the first select voltage signal Vsel_1 and the third select voltage signal Vsel_3 are led to the high level and the second select voltage signal Vsel_2 is led to the low level, opening the second and the third switches, SW2 and SW3, and closing the first and the fourth switches, SW1 and SW4, respectively, applying to the gate terminal of the driver transistor TP a voltage equal to the sum of the input voltage signal Vdata and of the voltage value stored in the bootstrap capacitor Cbs, equal to the value of threshold voltage Vtf1 of the driver transistor TP, and generating a driving current $I_{DS}$ given by the above reported relation (5).

In particular, in the data-input step, the storage capacitor Cst stores the charge supplied to the gate terminal of the driver transistor TP, i.e., to the first inner circuit node X1, until a new input voltage signal Vdata is received.

Moreover, in the compensation step, the bootstrap capacitor Cbs, when the voltage across it is higher than the value of the threshold voltage Vtf1 of the driver transistor TP, determines the conduction of this transistor, which, in turn, triggers the discharge step of the bootstrap capacitor Cbs, which goes on until the voltage value across the bootstrap capacitor Cbs reaches exactly the desired value of the threshold value Vtf1 of the driver transistor TP when the driver transistor TP is disabled and the bootstrap capacitor Cbs maintains the voltage value attained, i.e., the value of the threshold voltage Vtf1 of the driver transistor TP, as previously explained.

It is to be emphasized that the driving circuit 10 according to the disclosure is rather strong against the possible variations of the threshold voltage values of the TFT transistors contained therein for the driving of the OLED diodes. In this way, the problems connected to the lightning uniformity of a display of the AM-OLED type are overcome, i.e., of a display having a matrix of pixels including a plurality of these OLED diodes, driven by means of a driving circuit of the type described.

Figure 13:
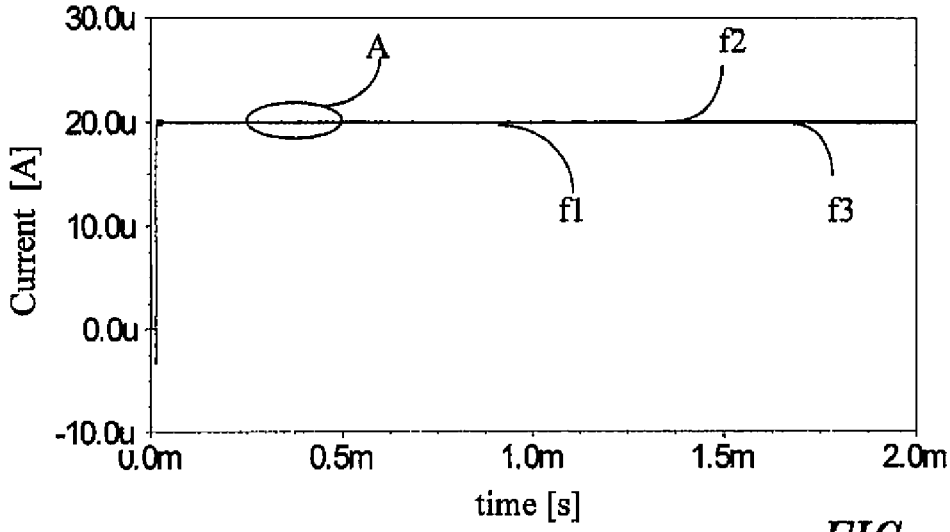
FIG. 13 schematically shows the progress of a current signal obtained by the driving circuit of FIG. 6A.

In particular, simulations carried out by the applicant with a driving circuit 10 including TFT transistors with the following form factors or dimensional relations:

W/L=(10 μm)/(2 μm) for the TFT driver transistor TF1 and for the fourth TFT selection transistor TF5; and W/L=(2 μm)/(2 μm) for the TFT selection transistors, TF2, TF3 and TF4, and with values of the storage Cst and bootstrap Cbs capacitors equal to 1 pF, have revealed negligible variations of the driving drain current IDS of the OLED diode OL when the threshold voltage Vtf1 of the TFT driver transistor TF1 varies, as shown in FIG. 13.

In particular, it is immediately verified that, when the threshold voltage Vtf1 varies of ±10% (Vtf1=2.0±0.2 V), the current IDS supplied to the OLED diode OL suffers from this variation in a negligible way.

Figure 14:
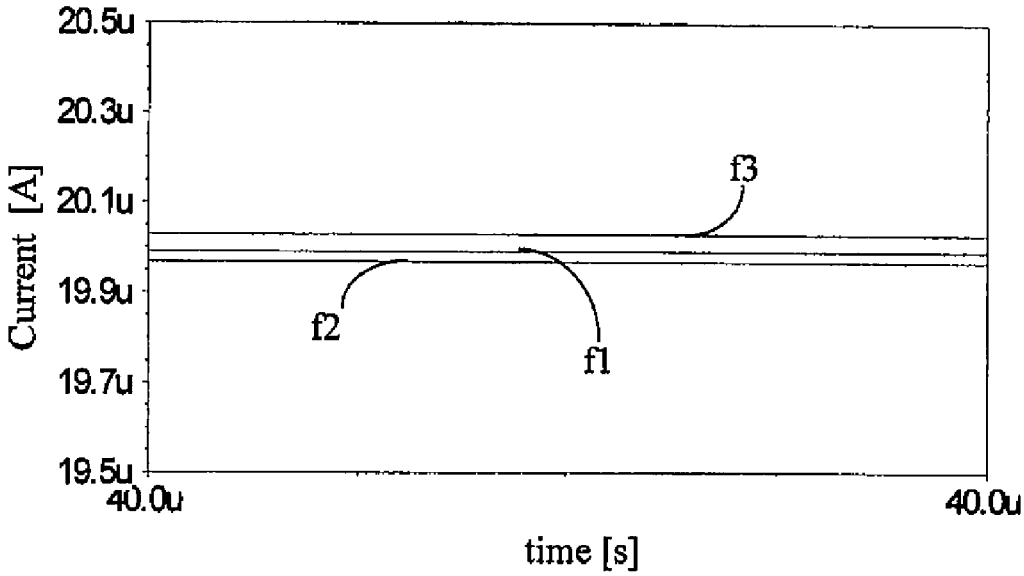
FIG. 14 schematically shows an enlarged view of the progress of a portion of the current signal of FIG. 13.

To appreciate this infinitesimal variation, an enlargement of the portion A of FIG. 13 is shown in FIG. 14, the curves f1, f2 and f3 corresponding to values of Vtf1 equal to 2.0, 1.8 and 2.2, respectively. In correspondence with a variation of ±10% of the threshold voltage Vtf1 of the TFT driver transistor TF1, there occurs then a relative variation equal to 0.2% in the current IDS flowing through the OLED diode OL.

Reminding that the specifications in terms of the luminosity of an OLED diode is requested depend on the type of application for which the diode is intended, the resulted luminosity uniformity has been obtained thanks to the driving circuit 10 for applications to the mobile telephony, where the luminosity varies in the range [140÷160] cd/m$^2$.

These specifications derive from that for applications such as cell phones, the display is placed at a few tens of centimeters from the eyes, and thus a range of luminosity centered on 150 cd/m$^2$ is more than acceptable.

To obtain a luminosity of 150 cd/m$^2$ it is necessary to supply the OLED diode with a current density (J) of 4 mA/cm$^2$. Considering that the area occupied by the OLED is of 19677.38 μm$^2$ (mean value of the range of areas previously indicated), it is deduced that the luminosity of 150 cd/m$^2$ is obtained for a current equal to 0.78 μA.

Figure 15:
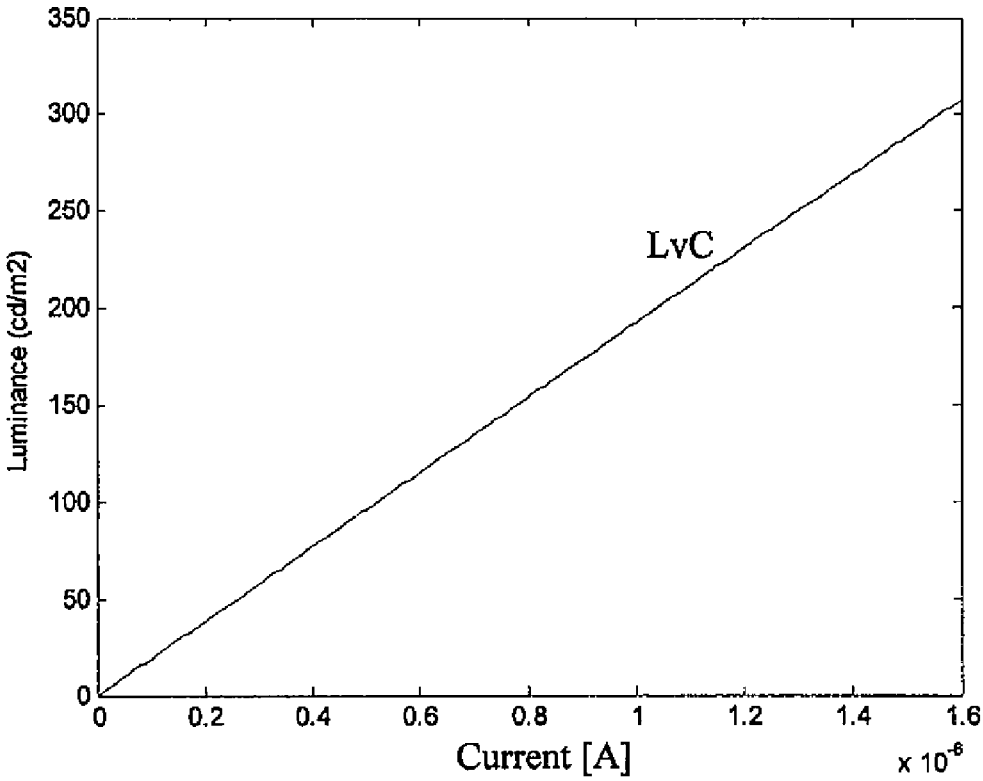
FIG. 15 schematically shows the luminosity characteristic curve as a function of the current of an OLED diode for mobile phone applications.

Supposing the above, the luminosity characteristic as a function of the current takes then the form shown in FIG. 15, indicated as LvC.

For a current flowing in the OLED diode OL of the value of 0.78 μA, at a variation of the threshold voltage of $T_1$ of ±10%, in the case of the driving circuit 10 according to the disclosure, there is a relative variation of the current of about 4.5%.

The luminosity values in relation to the above exposed variations are indicated in the following table:

TABLE 1

| Current (μA) | Luminosity (cd/m$^2$) |
|---|---|
| 0.78 | 150 |
| 0.8151 (+4.5%) | 156.75 |
| 0.7449 (−4.5%) | 143.25 |

Considering that the uniformity of luminosity is the value of how the luminosity differs on a display, a level of non uniformity equal to 5-8% is acceptable for video applications. It is however of same importance that this uniformity does not change too much in width on small areas of the display, since the human eye is sensitive to these differences.

Figure 1:
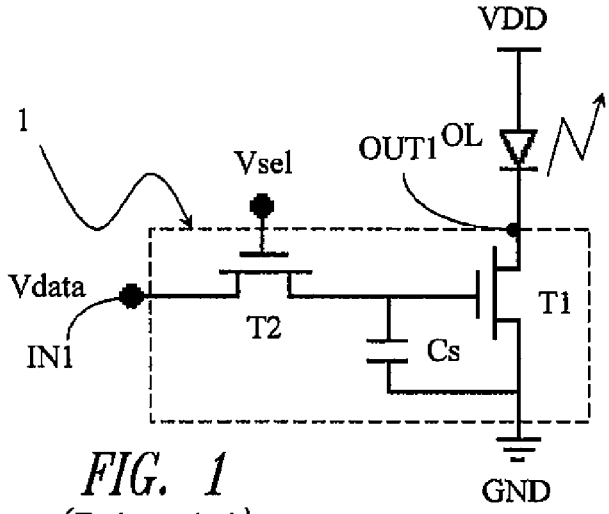
FIG. 1 (Prior Art)
FIG. 1 schematically shows a first embodiment of a driving circuit according to a prior solution.
Figure 2:
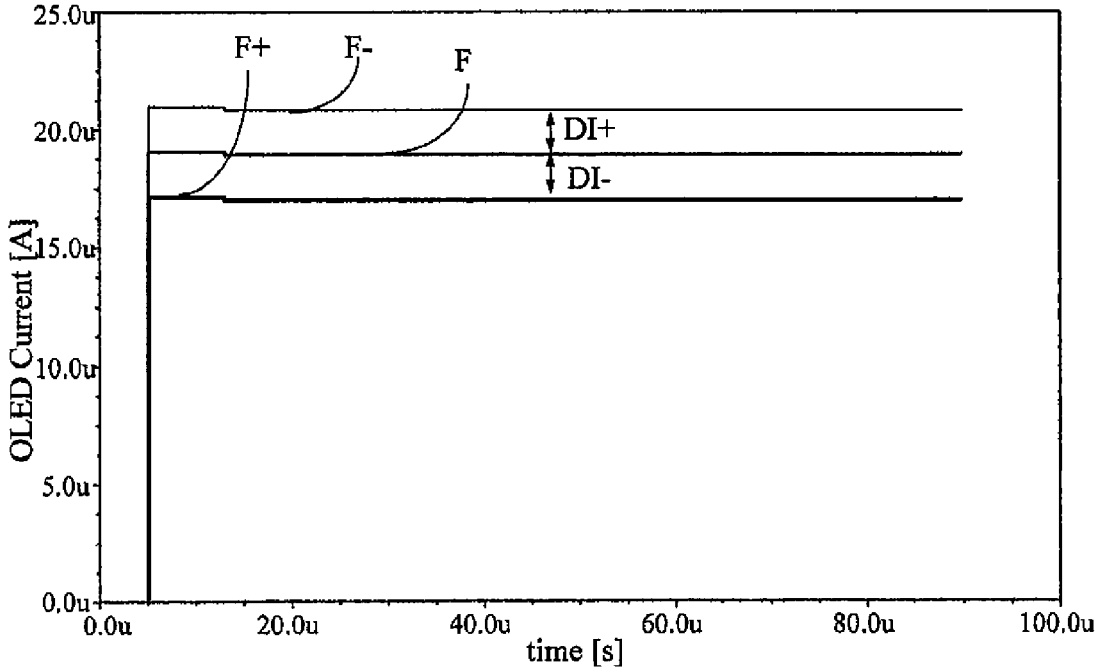
FIG. 2 (Prior Art)
FIG. 2 schematically shows the progress of a current signal obtained by the driving circuit of FIG. 1.
Figure 3:
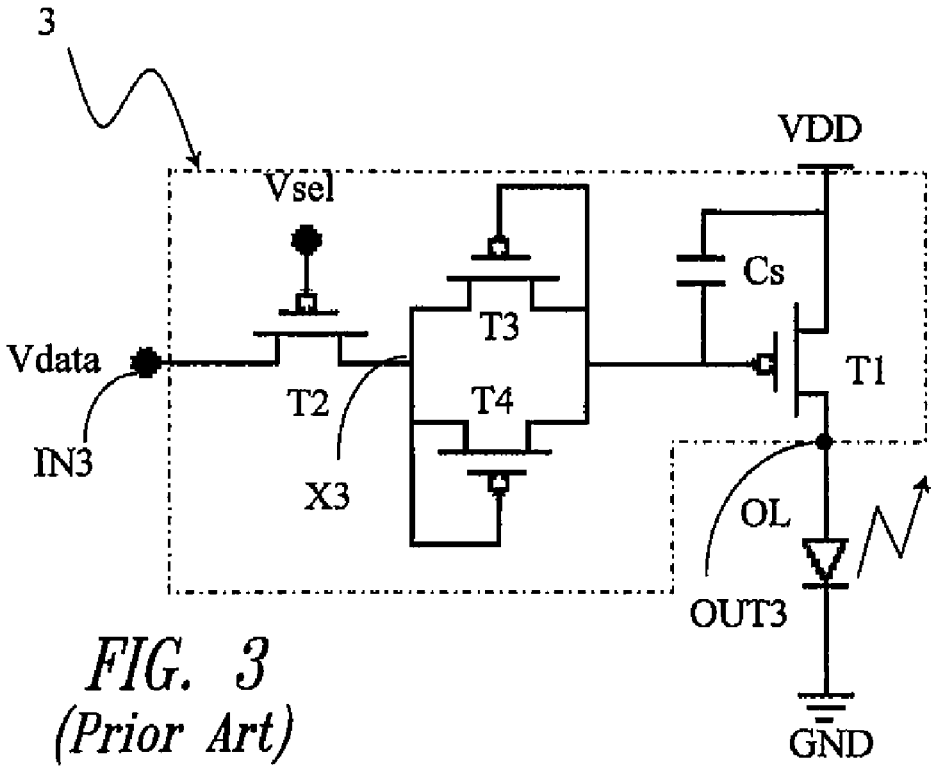
FIG. 3 (Prior Art)
FIG. 3 schematically shows a second embodiment of a driving circuit according to a prior solution.
Figure 4:
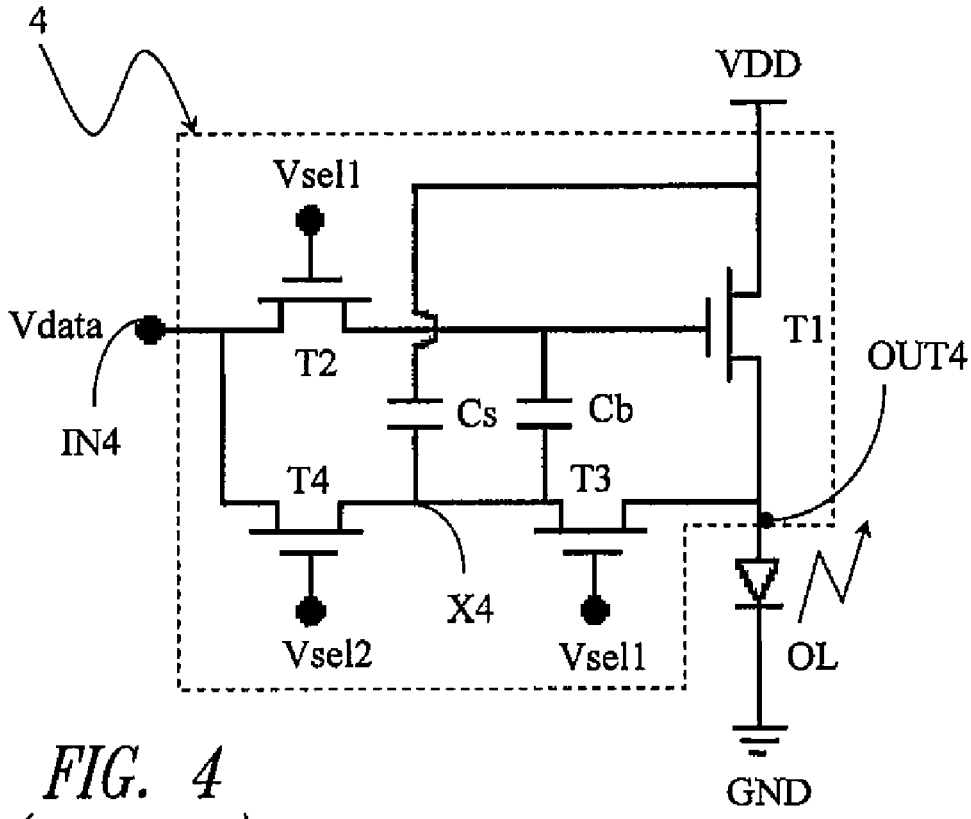
FIG. 4 (Prior Art)
FIG. 4 schematically shows a third embodiment of a driving circuit according to the a prior solution.
Figure 5:
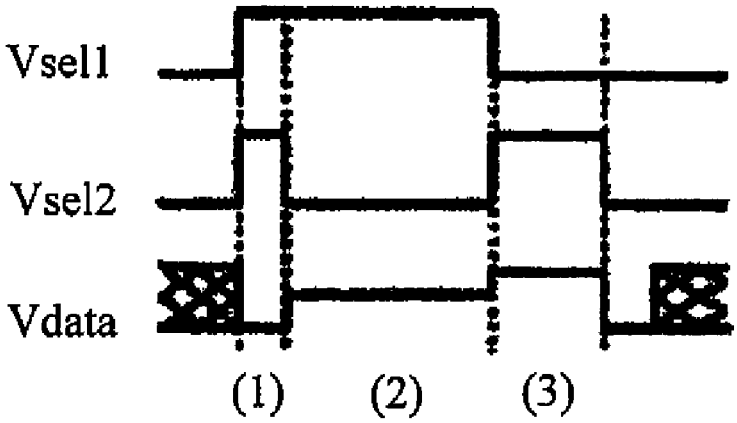
FIG. 5 (Prior Art)
FIG. 5 schematically shows the progress of control signals of the driving circuit of FIG. 4.
Figure 16:
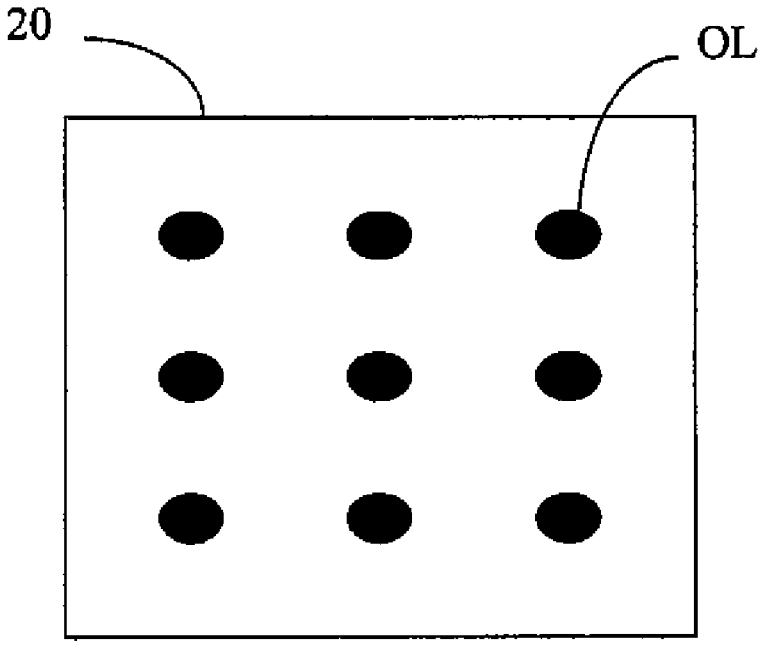
FIG. 16 schematically shows a portion of an AM-OLED display.

For a correct measurement of the luminosity uniformity of an AM-OLED display driven by the driving circuit 10 according to the disclosure, a portion 20 of the same constituted by nine OLED diodes OL, as shown in FIG. 16, has then been considered.

For each diode, it is also assumed that the minimum and maximum variation of luminosity is contained within the values defined in the above indicated Table 1.

The minimum (or negative) and maximum (or positive) luminosity variations are then given by the following relations:

$$Non\ Uniformitd\ \ Positiva = 100\,\% \frac{L_{Max} - L_{Media}}{L_{Media}}$$

$$Non\ Uniformitd\ \ Negativa = 100\,\% \frac{L_{Min} - L_{Media}}{L_{Media}}$$

Positive/Negative Non Uniformity

Mean

From these relations, it is understood that, by using the driving circuit 10 according to the disclosure, these values of positive and negative non uniformity (in absolute value) are equal to 4.5%, thus falling within the limits allowed for the application considered.

In the case of applications where OLED diodes are used with greater areas (for example, in the displays for television sets), the increase in driving current is to be taken into account, the increase implying a reduction of the current variation as a function of the threshold voltage variation with consequent decrease of the positive and negative non uniformity.

It is also suitable to remark that the increased sizes of the driving circuit 10 according to the disclosure with respect to the known circuits are negligible in most applications. In particular, the areas occupied by the single components of the driving circuit 10 are reported in the following table:

TABLE 2

| Component | Area (μm$^2$) |
|---|---|
| TFT 1 | 96 |
| TFT 2 | 96 |
| TFT 3 | 72 |
| TFT 4 | 72 |
| TFT 5 | 72 |
| Cb | 3900 |
| Cs | 3900 |

The total area of the driving circuit 10 is thus 8208 μm$^2$. It is however known that the OLED diodes, used for example in the field of the mobile telephony, have an area occupation that varies in the range [16129÷23225.76]μm$^2$, therefrom it is deduced that the area occupied by the OLED diode OL is at least 1.9 times that of the driving circuit 10.

Finally, the power dissipated by the driving circuit 10 according to the disclosure has been evaluated for an AM-OLED display, obtained as sum of the power supplied by the voltage generators which take care of the opening and of the closing of the selection transistors during the three periods or steps for the generation of the IDS current, by the generator of the input voltage signal Vdata, and of the power supplied by the supply voltage reference VDD. Moreover, both the static power dissipated by the driving circuit 10, evaluated when the signals constituting the Timing diagram take determined configurations, and the dynamic power rising during the switches of these signals have been determined.

In the following tables, the cumulative power values for the above defined three periods are reported:

TABLE 3

| static power | | | |
|---|---|---|---|
| SIGNAL | STATIC POW. (Watt) first initialization period P1 | STATIC POW. (Watt) Second compensation period P2 | STATIC POW. (Watt) third data-input period P3 |
| $V_{sel_1}$ | 0 | 0 | 0 |
| $V_{sel_2}$ | 0.11e$^{-6}$ | 0 | 0 |
| $V_{sel_3}$ | 0 | 0 | 0 |
| $V_{data}$ | 0 | 0 | 0 |
| $V_{DD}$ | 15e$^{-6}$ | 0.06e$^{-6}$ | 5e$^{-6}$ |
| Total | 15.11e$^{-6}$ | 0.06e$^{-6}$ | 5e$^{-6}$ |

TABLE 4

| dynamic power | | | |
|---|---|---|---|
| SIGNAL | DYNAMIC POW. (Watt) first initialization period P1 | DYNAMIC POW. (Watt) second compensation period P2 | DYNAMIC POW. (Watt) third data-input period P3 |
| $V_{sel_1}$ | 0 | 0 | $49e^{-6}$ |
| $V_{sel2}$ | $21.5e^{-6}$ | $37e^{-6}$ | $69.5e^{-6}$ |
| $V_{sel3}$ | 0 | 0 | 0 |
| $V_{data}$ | 0 | 0 | $1.72e^{-6}$ |
| $V_{DD}$ | $330e^{-6}$ | $38.5e^{-6}$ | $35.5e^{-6}$ |
| Total | $351.5e^{-6}$ | $75.5e^{-6}$ | $155.72e^{-6}$ |

From these tables it is thus derived that, for the driving circuit 10:

TOTAL STATIC POWER=$20.17e^{-6}$ W

TOTAL DYNAMIC POWER=$582.72e^{-6}$W extremely acceptable values in most applications, in particular in the case of application to the mobile telephony.

In conclusion, the driving circuit according to the disclosed embodiments allows to obtain a self-regulated compensation of the threshold voltage variations of the TFT driver transistors contained therein.

The driving circuit 10 proposed thus provides for a correct driving of a matrix of OLED diodes, ensuring a lightning uniformity of a display of the AM-OLED type, with limited increase of the occupation area of the circuit itself and reasonable dissipated power values.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet, are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A driving circuit for an OLED diode, the driving circuit comprising:

a first voltage terminal and a second voltage terminal;

an input terminal structured to receive an input voltage signal and an output terminal structured to output a driving current for the OLED diode;

a driver transistor having a first conduction terminal coupled to the first voltage terminal, a second conduction terminal coupled to the output terminal, and a control terminal;

a first capacitor and a second capacitor, the first capacitor directly connected to the control terminal and an inner circuit node and the second capacitor directly connected to the inner circuit node and the second voltage terminal;

a first switch driven by a first select voltage signal and coupled between the input terminal and the inner circuit node;

a second switch and a third switch structured to be driven by a second select voltage signal, the second switch coupled between the first conduction terminal and the control terminal of the driver transistor, and the third switch coupled between the inner circuit node and the second voltage terminal and being in parallel with the second capacitor; and a fourth switch driven by a third select voltage signal and inserted between the first voltage terminal and the first conduction terminal of the driver transistor, wherein the second capacitor and the third switch are directly connected to the OLED diode cathode, and the second conduction terminal of the driver transistor is directly connected to the OLED diode anode.

2. The driving circuit according to claim 1, wherein the first switch is structured to open in response to the first select voltage signal, the second and third switches are structured to conduct in response to the second select voltage signal, and the fourth switch is structured to conduct in response to the third select voltage signal, the first capacitor structured to charge with a voltage value higher than a threshold voltage value of the driver transistor in response to the opening of the first switch and the conduction of the second, third, and fourth switches.

3. The driving circuit according to claim 2, wherein the fourth switch is structured to open in response to a switching of the third select voltage signal, the first capacitor structured to discharge in response to the opening of the fourth switch so that a voltage value across terminals of the first capacitor is led to a value equal to the threshold voltage of said driver transistor.

4. The driving circuit according to claim 3, wherein the second and third switches are structured to open and the first and fourth switches are structured to close in response to a switching of the first, second, and third select voltage signals and to apply to the control terminal of the driver transistor a voltage equal to the sum of the input voltage signal and of the voltage value stored in the first capacitor, the driver transistor structured to respond to the voltage applied to its control terminal and to output the driving current according to the following relation:

$$\begin{aligned} I_{DS} &= \mu_0 C_{ox} \frac{W}{L} \cdot \frac{(V_{GS1} - V_{tf1})^2}{2} \\ &= \mu_0 C_{ox} \frac{W}{L} \cdot \frac{(V_{data} + V_{tf1} - V_{tf1})^2}{2} \\ &= \mu_0 C_{ox} \frac{W}{L} \cdot \frac{V_{data}^2}{2} \end{aligned}$$

wherein:

$V_{GS1}$, $V_{tf1}$, Cox, $\mu_0$, W and L are, respectively, the voltage value between the gate and source terminals, the threshold voltage value, the capacitance by surface unit, the mobility of the charge carriers, and the gate width and length of said driver transistor.

5. The driving circuit according to claim 4, wherein the second capacitor is structured to store the charge supplied to said control terminal of said driver transistor until a new input voltage signal comes, in response to the switching of first, second, and third select voltage signals.

6. The driving circuit according to claim 1, wherein said driver transistor is realized by a thin film N-channel transistor.

7. The driving circuit according to claim 1, wherein said first, second, third and fourth switches are realized by respective thin film N-channel transistors.

8. A method for generating a driving current of an OLED diode by means of a driving circuit having a first voltage terminal and a second voltage terminal, an input terminal structured to receive an input voltage signal and an output terminal structured to output a driving current for the OLED diode, a driver transistor having a first conduction terminal coupled to the first voltage terminal, a second conduction terminal coupled to the output terminal, and a control terminal, the driving circuit also including a first capacitor and a second capacitor, the first capacitor directly connected to the control terminal and an inner circuit node and the second capacitor directly connected to the inner circuit node and the second voltage terminal, a first switch driven by a first select voltage signal and coupled between the input terminal and the inner circuit node, a second switch and a third switch structured to be driven by a second select voltage signal, the second switch coupled between the first conduction terminal and the control terminal of the driver transistor, and the third switch coupled between the inner circuit node and the second voltage terminal and being in parallel with the second capacitor, and a fourth switch driven by a third select voltage signal and inserted between the first voltage terminal and the first conduction terminal of the driver transistor, wherein the second capacitor and the third switch are directly connected to the OLED diode cathode, and the second conduction terminal of the driver transistor is directly connected to the OLED diode anode, the method comprising:

initializing the driving circuit so that the first select voltage signal is at a first level enabling the opening of said first switch, said second select voltage signal is led to a second level, enabling the closing of said second and third switches and said third select voltage signal is at said second level, enabling the closing of said fourth switch, and triggering a charge step of said first capacitor with a function of a bootstrap at a voltage value higher than a threshold voltage value of said driver transistor;

compensating the driving circuit so that the first and second select voltage signals are maintained at the same level as in the previous initialization step, respectively said first and second levels, while said third select voltage signal is led to said first level, enabling the opening of said fourth switch, said first switch being kept open, and triggering in this way a discharge step of said first capacitor, thereby a voltage value across it is led to a value equal to said threshold voltage of said driver transistor; and inputting data, wherein said first and third select voltage signals are led to said second level and said second select voltage signal is led to said first level, enabling the opening of said second and third switches and the closing of said first and fourth switches, respectively, thus applying to said control terminal of said driver transistor a voltage equal to the sum of said input voltage signal and of said voltage value stored in said first bootstrap capacitor, equal to said threshold voltage value of said driver transistor and generating said driving current according to the following relation:

$$I_{DS} = \mu_0 C_{ox} \frac{W}{L} \cdot \frac{(V_{GS1} - V_{tf1})^2}{2} \tag{5}$$

-continued $$= \mu_0 C_{ox} \frac{W}{L} \cdot \frac{(V_{data} + V_{tf1} - V_{tf1})^2}{2}$$

$$= \mu_0 C_{ox} \frac{W}{L} \cdot \frac{V_{data}^2}{2}$$

wherein:

$V_{GS1}$, $V_{tf1}$, COX, $\mu_0$, W and L are, respectively, the voltage value between the gate and source terminals, the threshold voltage value, the capacity by surface unit, the mobility of the charge carriers, the gate width and length of said driver transistor.

9. The method for generating a driving current according to claim 8, wherein in said inputting data step, said second capacitor stores the charge supplied to said control terminal of said driver transistor, until a new input voltage signal comes.

10. The method for generating a driving current according to claim 8, wherein in said compensating, said first bootstrap capacitor, when the voltage across its terminals is higher than said threshold voltage value of said driver transistor, determines the conduction of said transistor, which, in turn, triggers a discharge step of said first bootstrap capacitor, which goes on until the voltage value across said first bootstrap capacitor reaches exactly the value of said threshold voltage of said driver transistor, when said driver transistor is disabled and said first bootstrap capacitor maintains the voltage value attained.

11. A circuit for driving an organic light emission diode (OLED), the circuit comprising:

a driver transistor having a first conduction terminal coupled to a first voltage reference, a second conduction terminal coupled to an output that is coupled to a second voltage reference, and a control terminal;

a first capacitor directly connected to a first node and to the control terminal of the driver transistor;

a second capacitor directly connected to the first node and to the second voltage reference;

a first switch coupled between an input terminal and the first node;

a second switch coupled between the first conduction terminal of the driver transistor and the control terminal of the driver transistor;

a third switch coupled between the first node and the second voltage reference and being in parallel with the second capacitor; and a fourth switch coupled between the first voltage reference and the first conduction terminal of the driver transistor, wherein the second capacitor and the third switch are directly connected to the OLED diode cathode, and the second conduction terminal of the driver transistor is directly connected to the OLED diode anode.

12. The circuit of claim 11, wherein the driving circuit generates a driving current on the output at the second terminal of the driver transistor in accordance with the following relationship:

$$I_{DS} = \mu_0 C_{ox} \frac{W}{L} \cdot \frac{(V_{GS1} - V_{tf1})^2}{2}$$

$$= \mu_0 C_{ox} \frac{W}{L} \cdot \frac{(V_{data} + V_{tf1} - V_{tf1})^2}{2}$$

$$= \mu_0 C_{ox} \frac{W}{L} \cdot \frac{V_{data}^2}{2}$$

wherein:

$V_{GS1}$, $V_{tf1}$, COX, $\mu_0$, W and L are, respectively, the voltage value between the gate and source terminals, the threshold voltage value, the capacity by surface unit, the mobility of the charge carriers, the gate width and length of said driver transistor.

13. The circuit of claim 12, wherein the first capacitor is adapted to be charged to a higher voltage than the threshold voltage value of the driver transistor.

14. The circuit of claim 12, wherein the first capacitor is adapted to be charged when the first switch is open, and the second, third, and fourth switches are closed.

15. A display device, comprising:

a plurality of organic light emission diodes (OLEDs); and a circuit for driving each OLED, the circuit comprising:

a driver transistor having a first conduction terminal coupled to a first voltage reference, a second conduction terminal coupled to an output that is coupled to a second voltage reference, and a control terminal;

a first capacitor directly connected to a first node and to the control terminal of the driver transistor;

a second directly capacitor coupled connected to the first node and to the second voltage reference;

a first switch coupled between an input terminal and the first node;

a second switch coupled between the first conduction terminal of the driver transistor and the control terminal of the driver transistor;

a third switch coupled between the first node and the second voltage reference and being in parallel with the second capacitor; and a fourth switch coupled between the first voltage reference and the first conduction terminal of the driver transistor, wherein the second capacitor and the third switch are directly connected to the OLED diode cathode, and the second conduction terminal of the driver transistor is directly connected to the OLED diode anode.

16. The display device of claim 15, wherein the driving circuit generates a driving current on an output at the second terminal of the driver transistor in accordance with the following relationship:

$$\begin{aligned} I_{DS} &= \mu_0 C_{ox} \frac{W}{L} \cdot \frac{(V_{GS1} - V_{tf1})^2}{2} \\ &= \mu_0 C_{ox} \frac{W}{L} \cdot \frac{(V_{data} + V_{tf1} - V_{tf1})^2}{2} \\ &= \mu_0 C_{ox} \frac{W}{L} \cdot \frac{V_{data}^2}{2} \end{aligned}$$

wherein:

$V_{GS1}$, $V_{tf1}$, COX, $\mu_0$, W and L are, respectively, the voltage value between the gate and source terminals, the threshold voltage value, the capacity by surface unit, the mobility of the charge carriers, the gate width and length of said driver transistor.

17. The display device of claim 16, wherein the first capacitor is adapted to be charged to a higher voltage than the threshold voltage value of the driver transistor.

18. The display device of claim 16, wherein the first capacitor is adapted to be charged when the first switch is open, and the second, third, and fourth switches are closed.

* * * * *

UNITED STATES PATENT AND TRADEMARK OFFICE

CERTIFICATE OF CORRECTION

PATENT NO. : 8,111,217 B2
APPLICATION NO. : 12/019577
DATED : February 7, 2012
INVENTOR(S) : Claudia Caligiore et al.

It is certified that error appears in the above-identified patent and that said Letters Patent is hereby corrected as shown below:

Column 18, Lines 42-51:

$$I_{DS} = \mu_0 C_{ox} \frac{W}{L} \cdot \frac{(V_{GS1} - V_{tf1})^2}{2}$$
$$= \mu_0 C_{ox} \frac{W}{L} \cdot \frac{(V_{data} + V_{tf1} - V_{tf1})^2}{2}$$
$$= \mu_0 C_{ox} \frac{W}{L} \cdot \frac{V_{data}^2}{2}$$

" " should read, $$I_{DS} = \mu_0 C_{ox} \frac{W}{L} \cdot \frac{(V_{GS1} - V_{tf1})^2}{2}$$
$$= \mu_0 C_{ox} \frac{W}{L} \cdot \frac{(V_{data} + V_{tf1} - V_{tf1})^2}{2}$$
$$= \mu_0 C_{ox} \frac{W}{L} \cdot \frac{V_{data}^2}{2}$$

-- --.

Column 19, Lines 58-59:
"and of said voltage value stored in said first bootstrap capacitor" should read, --and of said voltage value stored in said first capacitor--.

Columns 19-20, Lines 64-65 and 1-7:

$$I_{DS} = \mu_0 C_{ox} \frac{W}{L} \cdot \frac{(V_{GS1} - V_{tf1})^2}{2}$$
$$= \mu_0 C_{ox} \frac{W}{L} \cdot \frac{(V_{data} + V_{tf1} - V_{tf1})^2}{2}$$
$$= \mu_0 C_{ox} \frac{W}{L} \cdot \frac{V_{data}^2}{2}$$

" " should read,

Signed and Sealed this
First Day of May, 2012

David J. Kappos

David J. Kappos
*Director of the United States Patent and Trademark Office*

$$I_{DS} = \mu_0 C_{ox} \frac{W}{L} \cdot \frac{(V_{GS1} - V_{tf1})^2}{2}$$
$$= \mu_0 C_{ox} \frac{W}{L} \cdot \frac{(V_{data} + V_{tf1} - V_{tf1})^2}{2}$$
$$= \mu_0 C_{ox} \frac{W}{L} \cdot \frac{V_{data}^{\ 2}}{2}$$

-- --.

Column 20, Lines 57-66:

$$I_{DS} = \mu_0 C_{ox} \frac{W}{L} \cdot \frac{(V_{GS1} - V_{tf1})^2}{2}$$
$$= \mu_0 C_{ox} \frac{W}{L} \cdot \frac{(V_{data} + V_{tf1} - V_{tf1})^2}{2}$$
$$= \mu_0 C_{ox} \frac{W}{L} \cdot \frac{V_{data}^2}{2}$$

" " should read, $$I_{DS} = \mu_0 C_{ox} \frac{W}{L} \cdot \frac{(V_{GS1} - V_{tf1})^2}{2}$$
$$= \mu_0 C_{ox} \frac{W}{L} \cdot \frac{(V_{data} + V_{tf1} - V_{tf1})^2}{2}$$
$$= \mu_0 C_{ox} \frac{W}{L} \cdot \frac{V_{data}^{\ 2}}{2}$$

-- --.

Column 21, Line 21:
"a second directly capacitor coupled connected to the first" should read, --a second capacitor directly connected to the first--.

Column 22, Lines 9-18:

$$I_{DS} = \mu_0 C_{ox} \frac{W}{L} \cdot \frac{(V_{GS1} - V_{tf1})^2}{2}$$
$$= \mu_0 C_{ox} \frac{W}{L} \cdot \frac{(V_{data} + V_{tf1} - V_{tf1})^2}{2}$$
$$= \mu_0 C_{ox} \frac{W}{L} \cdot \frac{V_{data}^2}{2}$$

" " should read,

--

$$
\begin{aligned}
I_{DS} &= \mu_0 C_{ox} \frac{W}{L} \cdot \frac{\left(V_{GS1} - V_{tf1}\right)^2}{2} \\
&= \mu_0 C_{ox} \frac{W}{L} \cdot \frac{\left(V_{data} + V_{tf1} - V_{tf1}\right)^2}{2} \\
&= \mu_0 C_{ox} \frac{W}{L} \cdot \frac{V_{data}^{\ 2}}{2}
\end{aligned}
$$

--.